US005329499A

United States Patent [19]

Molund et al.

[11] Patent Number: 5,329,499

[45] Date of Patent: Jul. 12, 1994

[54] ACOUSTIC TRANSMITTER

[75] Inventors: Gunnar Molund; Rune Tenghamn; Magnus Zetterlund, all of Västeras, Sweden

[73] Assignee: ABB Atom AB, Västeras, Sweden

[21] Appl. No.: 989,010

[22] PCT Filed: Sep. 16, 1991

[86] PCT No.: PCT/SE91/00612

§ 371 Date: Mar. 12, 1993

§ 102(e) Date: Mar. 12, 1993

[87] PCT Pub. No.: WO92/06567

PCT Pub. Date: Apr. 16, 1992

[30] Foreign Application Priority Data

Sep. 28, 1990 [SE] Sweden ..... 9003086-7

[51] Int. Cl.[5] ..... H04R 23/00

[52] U.S. Cl. ..... 367/174; 367/168; 381/190

[58] Field of Search ..... 367/159, 163, 174, 168; 310/337; 381/190

[56] References Cited

U.S. PATENT DOCUMENTS

| | | | |
|---|---|---|---|
| 4,384,351 | 5/1983 | Pagliarini et al. | 367/175 |
| 4,706,230 | 11/1987 | Inoue et al. | 367/174 |
| 4,764,907 | 8/1988 | Dahlstrom et al. | 367/163 |
| 4,845,688 | 7/1989 | Butler | 367/174 |
| 4,858,206 | 8/1989 | McMahon | 367/163 |
| 4,901,293 | 2/1990 | Kuhn | 367/168 |
| 5,016,228 | 5/1991 | Arnold et al. | 367/163 |
| 5,029,148 | 7/1991 | Arnold et al. | 367/163 |

*Primary Examiner*—J. Woodrow Eldred

*Attorney, Agent, or Firm*—Watson, Cole, Grindle & Watson

[57] ABSTRACT

A drive package for acoustic transmitters includes a frame (6) of magnetic material with windows for accommodating driving members (20) and prestress devices (22). Two windows with driving members and an intermediate window with a prestress device form a column which, by way of pressure studs (24) in the driving members and holes (14) in the frame, clamp pressure rods (4) located inside the transmitter against the shell (1) of the transmitter. The drive package may include several columns.

8 Claims, 1 Drawing Sheet

FIG. 1
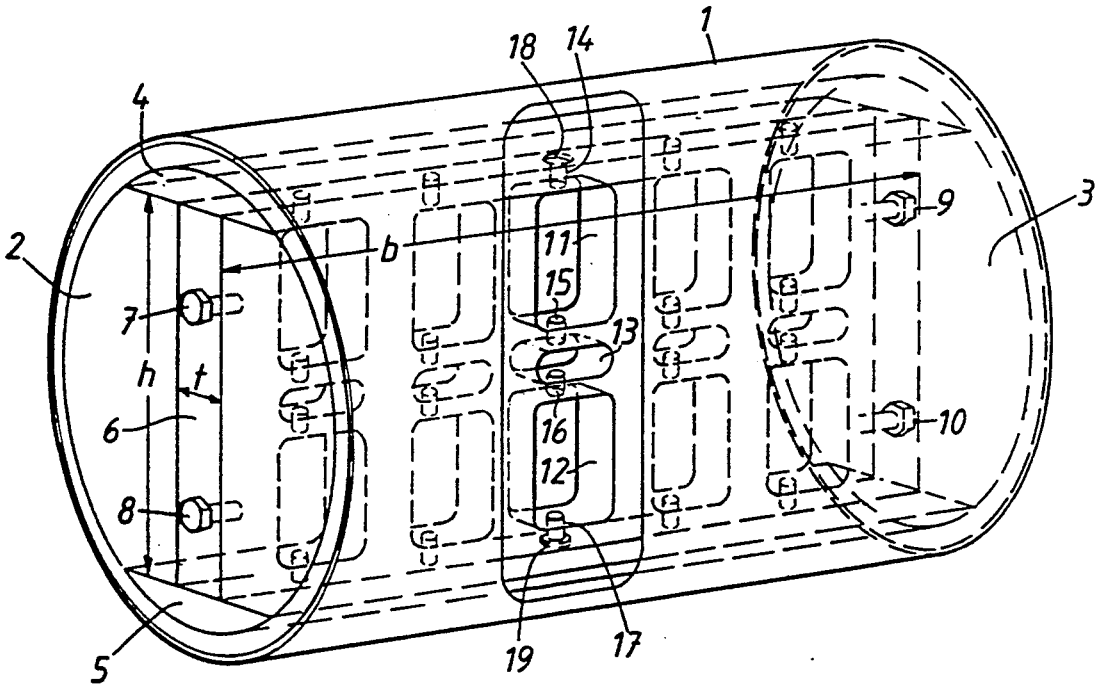
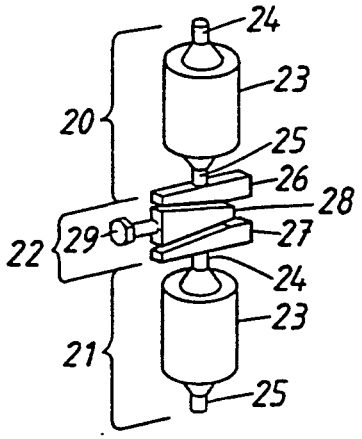
FIG. 2

ACOUSTIC TRANSMITTER

BACKGROUND OF THE INVENTION

1. Field of the Invention

The invention relates to a drive package for acoustic transmitters Current acoustic devices are able to operate both as transmitters and receivers, that is, as measuring transducers for acoustic signals. An acoustic device in which the invention may be used to great advantage is as a so-called Sonar, that is, a transmitter which sends out sound waves under water which, after reflection, can be monitored by hydrophones of various kinds.

2. The Prior Art

It is a well-known fact that low-frequency sound waves can travel longer distances through water than can high-frequency sound waves. For a long time there has also been a considerable need for powerful low-frequency sound transmitters which are capable of working under water, both from a military point of view and from the point of view of the offshore oil and gas industry. Transmitters of various designs for these purposes and fields of use have been available on the market for quite a long time. A summary of such acoustic transmitters is given in an article in DEFENSE SYSTEM REVIEW, November 1984, pages 50–55 entitled "Sonar Transducer Design Incorporates Rare Earth Alloy".

Most acoustic transmitters which are used at present are based on either the piezoelectric effect or on magnetostriction. As is well-known, the piezoelectric effect means that a crystalline substance is subjected to a change in length when an electric voltage is applied to its end surfaces and that a voltage is obtained when the substance is subjected to a physical deformation, respectively. The magnetostriction means that a magnetic material which is subjected to a change of the magnetic flux suffers a change in length and that an externally caused change in length gives rise to a change in the magnetic flux, respectively. This means that a transmitter which utilizes these effects can also, in principle, be used as a receiver.

A variety of different embodiments of acoustic transmitters exist. In low-frequency applications it is common that they have a cylindrical shape with either a circular or elliptical cross section area.

The greatest problem with this type of transmitter is to achieve a sufficiently great amplitude of the oscillations. To this end, either a large transmitter area or a small transmitter area with great amplitude of oscillation would be required.

The introduction of the so-called giant magnetostrictive materials has improved the conditions for obtaining good acoustic transmitters. With such materials as driving elements, amplitude changes may be obtained which may largely amount to 100 times the corresponding changes using piezoelectric materials or using ordinary magnetic materials. Transmitters which utilize these giant magnetostrictive materials have existed on the market for several years.

A frequently occurring embodiment for the actual driving will be described in greater detail starting from a cylindrical transmitter with an elliptical cross section. The cylindrical envelope surface consists of an elastic diaphragm or shell. Inside and parallel to the axis of the cylinder and making contact with the shell are two rods applying pressure to the shell. The cross sectional area of the rods is symmetrically mirror-inverted in relation to the minor axis of the elliptical shell and each rod is delimited by that part of the shell which faces the end of the major axis and a chord parallel to the minor axis. Between the rods and making contact with their plane-parallel sides there is arranged an electrically controlled driving element in the form of a driving rod. The longitudinal axis of the driving rod coincides with the major axis of the elliptically formed cross section and lies midway between the end surfaces of the transmitter. In those case where the magnetostrictive effect is utilized, the driving rod consists of a magnetic material, suitably a giant magnetostrictive material, which with a surrounding winding is magnetized to keep pace with the desired frequency of the transmitter. If the piezoelectric effect is to be utilized, the driving rod is made of a piezoelectric material. The driving rod may, of course, consist in its entirety, or in certain parts, of a material with the desired possibilities of changing the length.

The fundamental embodiment of an acoustic transmitter described above may be different as regards the actual details. An acoustic transmitter with a cylindrical shape and with an elliptical cross section area and with driving rods of a giant magnetostrictive material is disclosed, inter alia, in U.S. Pat. No. 4,901,293 entitled "A Rare Earth Flextensional Transducer".

Swedish published patent application 8901905-3, entitled "Device in acoustic transmitters", also describes a cylindrical transmitter with elliptical cross section. The driving element consists of a body with oppositely located recesses into which pressure rods are inserted. The driving rods, in turn, are fixed into pressure rods which in the same way as above influence the diaphragm.

SUMMARY OF THE INVENTION

The invention comprises a basic concept for what has been called "driving element" above but which in the following will be referred to as "drive package" As regards the other parts of a transmitter, a design as the one described above, with a cylindrical shape with an elliptical cross section, is the starting-point. The transmitter has an elastic diaphragm or shell and two interior pressure rods at the ends of the major axis. Between these pressure rods, the drive package according to the invention is located.

The drive package comprises a plate of magnetic material with an outer shape like a rectilinear parallelepiped. In the plate a number of recesses or windows are provided, and for this reason the plate will be referred to as a "frame" in the following. There are two different hole configurations of the windows which, however, both have a parallelepipedic shape with rounded corners.

One window configuration, referred to below as "drive window", is shaped such that a driving member consisting of one or more drive cells mounted with the same axis of change of length may be accommodated in the window.

The other window configuration, referred to below as "prestress window", is shaped such that a prestress device according to the following description can be accommodated in the window. The prestress device consists of a wedge movable by means of a screw and located between two outer movable prestress lugs. On the sides facing the wedge, the prestress lugs are shaped such that they together form an angle equal to the wedge angle. The opposite outer sides of the prestress lugs are plane-parallel and move away from each other in a direction perpendicular to the direction of movement of the wedge when the wedge, via the screw, is moved into the angular opening between the prestress lugs.

The dimension of the frame with respect to its height is adapted such that it largely corresponds to the distance between the plane-parallel inner sides of the pressure rods, that is, the length of the major axis between the pressure rods. The width of the frame corresponds to the axial length of the cylindrical shell. The thickness of the frame may be varied within wide limits and is substantially determined by the necessary dimensions for the accommodation of the drive cells and the prestress devices into the windows. As will be described later on, the elliptically shaped end plates of the transmitter are fixed to the height/thickness sides of the frame. Otherwise, the frame is centered such that its mid-plane, that is, a plane halfway between the two width/height sides, coincides with a imaginary plane through the major axis and the longitudinal axis of the cylindrically shaped transmitter through the mid-point of the elliptically shaped cross section. From what has been stated above, it will be clear that the two width/-thickness sides of the frame are facing and are parallel to the plane-parallel sides of the pressure rods.

Two drive windows and a prestress window, located half-way between these, with coinciding centre lines parallel to the major axis of the elliptical cross section, forming a column, are provided in the frame. The frame may comprise an optional number of such parallel columns.

According to the above, a driving member comprising one or more drive cells are placed in the two drive windows. Each driving member terminates in pressure studs in the direction of the change of length. Clearance holes for these pressure studs are provided in the frame. In the pressure rods there are provided recesses for guiding and counter support for the pressure studs extending from the drive windows. In the intermediate prestress window there is placed a prestress device according to the above. The inner pressure studs of the driving member are connected to the plane-parallel outer sides of the prestress lugs.

According to, inter alia, the above-mentioned article in DEFENCE SYSTEM REVIEW, it is both known and suitable to use drive sources for seismic transmitters comprising giant magnetostrictive materials such as, for example, Terfenol. It is also known that for optimum function such drive sources need both mechanical prestressing and bias magnetization.

A suitable drive source for the use in the drive package according to the invention is a drive cell designed in accordance with U.S. Pat. No. 4,914,412, "Magnetic Circuit". This magnetic circuit is intended to magnetize cylindrically shaped magnetic materials, for example a giant magnetostrictive material, in the axial direction. The magnetic circuit comprises a magnetizing coil and permanent magnets for bias magnetization as well as magnetic return conductors of ferromagnetic material.

The desirable mechanical prestress is achieved with the aid of the prestress devices in the prestress windows. By inserting the wedge by means of the screw in between the prestress lugs, these will clamp the pressure rods to the diaphragm via the pressure studs of the driving members, thus obtaining the desired mechanical prestress of the drive cells. This, in turn, means that the frame will flow freely inside the diaphragm and that the end plates of the transmitter may be fixed to the frame without these end plates influencing the oscillating movement of the diaphragm to any mentionable extent.

The described concept for the embodiment of an acoustic transmitter entails great freedom as regards design, dimension and acoustic effect since both the number of drive cells in each driving member and the number of columns may be chosen freely. The frame concept also entails a good possibility of fixing the driving members and of fixing the pressure rods when manufacturing and winding the diaphragm. The frame also serves as a magnetic yoke for the magnetic circuits.

BRIEF DESCRIPTION OF THE DRAWING

FIG. 1 shows a cylindrical acoustic transmitter with elliptical cross section comprising a drive package according to the invention.

FIG. 2 shows driving members with a prestress device included in the drive package.

DESCRIPTION OF THE PREFERRED EMBODIMENT

An acoustic transmitter in which a drive package according to the invention may preferably be used is shown in FIG. 1. As is shown, the transmitter has a cylindrical shape with elliptical cross section. Externally, the transmitter consists of an envelope surface in the form of an elastic diaphragm 1 and end plates 2 and 3. Inside the diaphragm and parallel to the axis of the cylinder there are two pressure rods 4 and 5 at the ends of the major axis of the elliptical cross section, which is all in accordance with the prior art described above.

The drive package comprises a frame with a number of windows, driving members including one or more drive cells, and a prestress device consisting of a wedge and prestress lugs.

As described above, the frame 6 has the shape of a rectilinear parallelepiped. To facilitate the description in the following, reference will be made below to the height h, width b and thickness t of the frame. The frame is placed centrally inside the diaphragm in such a way that a plane midway between and parallel to the two height/width sides coincides with the plane for all the major axes. The height h of the frame is thereby adapted so as largely to correspond to the free distance between the pressure rods, which means that the width/thickness sides of the frame will practically make contact with the pressure rods. The width b of the frame corresponds to the axial length of the cylindrical diaphragm. The end plates of the transmitter may therefore be fixed by screws 7, 8, 9 and 10 to the height/-thickness sides of the frame. The thickness t of the frame, that is, the distance between the two height/-width sides, is for the most part determined by the demands on a practical mounting of the driving members and the prestress devices as well as the demands on the necessary dimensions of the clearance holes for the pressure studs. Since the frame is "floating" inside the transmitter when this is in a mechanically prestressed state with the aid of the prestress devices, the frame as such will not be subjected to any mentionable mechanical stresses. Therefore, the height and width of the frame will be substantially determined by the number of drive cells/drive members which are needed to attain the desired acoustic effect.

Two of the above-mentioned drive windows are shown at 11 and 12. As is shown, they have a parallelepipedic shape with rounded corners. Half-way between them is a prestress window 13, also of parallelepipedic shape with rounded corners. The windows have a common centre line which coincides with a major axis for the elliptical cross section. For the further description, it is suitable, as previously indicated, to state that the two drive windows and the intermediate prestress window forms a column. As can be seen, a seismic transmitter according to FIG. 1 comprises five columns. As previously stated, the driving members which are to be placed in the drive windows have axially-extending pressure studs. Clearance holes 14, 15, 16 and 17 for these pressure studs are provided in the frame with a common central axis line equal to the centre line of each column.

For the centering and guiding of the pressure studs as well as their counter support against the pressure rods, recesses 18 and 19 have been provided in the pressure rods as described above, these recesses having the same axis line as the centre line of the columns.

FIG. 2 shows an example of the design of two driving members 20 and 21 with an intermediate prestress device 22 for insertion in each column. The driving members consist of one or more drive cells 23. When several drive cells are used, these are mounted so as to have a common axial direction of extension. The pressure studs of the driving members are shown at 24 and 25. The prestress device comprises two prestress lugs 26 and 27 and an intermediate wedge 28. The driving members are clamped against the pressure rods when the wedge with the aid of a screw arrangement 29 is inserted between the prestress lugs. This screw arrangement as well as the guiding of the prestress lugs may be made in a plurality of different and trivial ways and will not, therefore, be described in more detail.

The basic concept described may be designed, as far as details are concerned, in a plurality of different ways which are all embraced by the invention. Besides selecting the number of columns, drive cells in each driving member and the dimensions of the frame as already mentioned, it may, for example, be a question of different embodiments of the windows and of the attachment of the end plates to the height/thickness sides of the frame. The wedge of the prestress device may also be conically formed, in which case those surfaces of the prestress lugs which are facing the wedge are also made conical with the same conicity as that of the wedge. The drive package may, of course, also be used in cylindrically formed transmitters with other than elliptical cross sections, for example with a circular cross section.

We claim:

1. An acoustic transmitter which has a cylindrical shape and which includes a shell arranged as an elastic diaphragm, pressure rods diametrically arranged inside the diaphragm, and a drive package arranged between the pressure rods; said device package comprising a frame, driving members and a prestress device, said frame being arranged as a rectilinear parallelepipedic plate of magnetic material with parallelepipedic recessed with rounded corners in the form of drive windows and prestress windows, wherein two drive windows with an intermediate prestress window form a column with a common center line diametrically between the pressure rods, wherein the frame includes at least on column, wherein the driving members are arranged in the drive windows and comprise at least one drive cell which is controllable and extendable, wherein ends of the driving members in the direction of extension are arranged as pressure studs for which clearance holes with the same center line as that of the window of the column are provided in the frame, both from the drive windows towards the pressure rods and towards an intermediate prestress window, wherein the pressure studs in one end of the driving members make contact with the pressure rods and in the other end make contact with the prestress devices arranged in the prestress windows, wherein the prestress devices comprise two prestress lugs with an intermediate wedge, and wherein the wedge is provided with a screw arrangement by means of which the wedge can be moved between the prestress lugs, whereby those pressure studs of the driving members which face the pressure rods will make contact with recesses in the pressure rods.

2. An acoustic transmitter according to claim 1, wherein the acoustic transmitter has an elliptical cross sectional shape.

3. An acoustic transmitter according to claim 1, wherein the acoustic transmitter has a circular cross sectional shape.

4. An acoustic transmitter according to claim 1, comprising a drive cell with a magnetic circuit which is bias magnetized by means of a permanent magnet and which has a magnetic core of a rare earth alloy.

5. An acoustic transmitter according to claim 1, comprising a drive cell with a piezoelectric element.

6. An acoustic transmitter according to claim 1, wherein the prestress lugs are arranged with confronting plane surfaces which make an angle with each other corresponding to the wedge angle of an intermediate plane wedge.

7. An acoustic transmitter according to claim 1, wherein the wedge has a conical shape and wherein surfaces of the prestress lugs which face the wedge are arranged to fit conically against the wedge.

8. An acoustic transmitter according to claim 1, including end plates which are fixed to the drive package.

* * * * *